US011174694B2

(12) United States Patent
McGarian

(10) Patent No.: US 11,174,694 B2
(45) Date of Patent: Nov. 16, 2021

(54) APPARATUS AND METHOD FOR MILLING A WINDOW IN A BOREHOLE

(71) Applicant: Bruce McGarian, Aberdeen Grampian (GB)

(72) Inventor: Bruce McGarian, Aberdeen Grampian (GB)

( * ) Notice: Subject to any disclaimer, the term of this patent is extended or adjusted under 35 U.S.C. 154(b) by 31 days.

(21) Appl. No.: 16/635,214

(22) PCT Filed: Jul. 25, 2018

(86) PCT No.: PCT/GB2018/052087
§ 371 (c)(1),
(2) Date: Jan. 30, 2020

(87) PCT Pub. No.: WO2019/025761
PCT Pub. Date: Feb. 7, 2019

(65) Prior Publication Data

US 2020/0347688 A1 Nov. 5, 2020

(30) Foreign Application Priority Data

Aug. 1, 2017 (GB) ..... 1712387

(51) Int. Cl.
*E21B 29/06* (2006.01)
*E21B 7/06* (2006.01)

(52) U.S. Cl.
CPC ..... *E21B 29/06* (2013.01); *E21B 7/061* (2013.01)

(58) Field of Classification Search
CPC ..... E21B 29/06
See application file for complete search history.

(56) References Cited

U.S. PATENT DOCUMENTS 2,799,479 A 7/1957 Kammerer
3,339,647 A 9/1967 Kammerer, Jr.
3,554,305 A 1/1971 Kammerer, Jr.
3,684,009 A 8/1972 Murray
(Continued)

FOREIGN PATENT DOCUMENTS

CN 202000941 U * 10/2011
CN 202000941 U 10/2011
(Continued)

OTHER PUBLICATIONS

International Search Report and Written Opinion for Application No. PCT/GB2018/052087 dated Feb. 13, 2019 (13 pages).

*Primary Examiner* — Taras P Bemko
(74) *Attorney, Agent, or Firm* — Michael Best & Friedrich LLP

(57) ABSTRACT

A tool for milling a window in a casing (3) of a borehole, the tool comprising: a main body having a longitudinal axis wherein, when the tool is run into a borehole, the longitudinal axis is substantially parallel with the longitudinal axis of the borehole, the main body comprising a deflection surface (7) which is disposed at an angle with respect to the longitudinal axis; a milling arrangement comprising a milling head (11) and a guidance surface (13), wherein the guidance surface is disposed at an angle with respect to the longitudinal axis of the tool and is in contact with the deflection surface; and a drive arrangement (14) which is operable to effect relative longitudinal movement between the main body and the milling arrangement.

17 Claims, 2 Drawing Sheets

(56) References Cited

U.S. PATENT DOCUMENTS

| | | | |
|---|---|---|---|
| 5,584,350 | A | 12/1996 | Schnitker et al. |
| 5,771,972 | A | 6/1998 | Dewey et al. |
| 5,816,324 | A | 10/1998 | Swearingen et al. |
| 5,829,518 | A | 11/1998 | Gano et al. |
| 6,401,821 | B1 | 6/2002 | Kennedy et al. |
| 6,722,452 | B1 | 4/2004 | Rial et al. |
| 9,404,331 | B2 | 8/2016 | Hekelaar |
| 2003/0098152 | A1 | 5/2003 | Kennedy et al. |
| 2004/0222022 | A1 | 11/2004 | Nevlud et al. |
| 2012/0186816 | A1 | 7/2012 | Dirksen et al. |
| 2013/0026401 | A1 | 1/2013 | Burkhaet et al. |
| 2013/0199784 | A1 | 8/2013 | Swadi et al. |
| 2014/0251616 | A1 | 9/2014 | O'Rourke et al. |
| 2015/0191999 | A1 | 7/2015 | Adam |
| 2016/0319619 | A1 | 11/2016 | Hekelaar |

FOREIGN PATENT DOCUMENTS

| | | | |
|---|---|---|---|
| GB | 2348898 | A | 10/2000 |
| WO | 2012088102 | A2 | 6/2012 |
| WO | 2014011162 | A1 | 1/2014 |
| WO | 2015185905 | A1 | 12/2015 |
| WO | 2017046613 | A1 | 3/2017 |

* cited by examiner

APPARATUS AND METHOD FOR MILLING A WINDOW IN A BOREHOLE

CROSS-REFERENCE TO RELATED APPLICATION DATA

This application is a U.S. national phase entry of International Application No. PCT/GB2018/052087, filed Jul. 25, 2018, which claims priority to GB Patent Application No. 1712387.8, filed Aug. 1, 2017, the entire contents of which are incorporated herein by reference in their entirety.

BACKGROUND

This invention relates to a method and apparatus for milling a window in a borehole.

It is often necessary to form a secondary borehole that extends laterally away from an existing borehole. A secondary borehole of this type is sometimes known as a lateral or sidetrack bore.

In most conventional methods for drilling a secondary borehole, a window must first be milled in the casing of the existing borehole. As the skilled reader will be aware, the casing comprises a generally cylindrical lining, formed from a robust material such as steel, which is provided within the existing borehole to separate the interior of the borehole from the surrounding formation.

In known methods, a whipstock is set in the existing borehole at a predetermined depth. A whipstock is a component which entirely or substantially entirely fills the borehole at its lower end, but which fills only a small proportion of the borehole at its upper end. Between the upper and lower ends an inclined face is formed.

A milling head is then pushed downwardly onto the upper end of the whipstock face. As the milling head is pushed progressively further down, the milling head is deflected laterally by the inclined whipstock face and mills a window in the casing of the borehole. Further driving of the milling head causes the milling head to begin milling into the formation surrounding the casing, and ultimately to begin the formation of the secondary borehole.

Known systems for milling a window in the casing of a borehole are disclosed in U.S. 5771972, U.S. Pat. No. 5,816,324, GB 2348898, WO 2014/011162, U.S. Pat. Nos. 5,584,350, 6,401,821, U.S. 2003/0098152 and U.S. 2013/0199784.

SUMMARY

It is an object of the present invention to provide an improved apparatus and method for milling a window in the casing of an existing borehole.

Accordingly, one aspect of the present invention provides a tool for milling a window in the casing of a borehole, the tool comprising: A main body having a longitudinal axis wherein, when the tool is run into a borehole, the longitudinal axis is substantially parallel with the longitudinal axis of the borehole, the main body comprising a deflection surface which is disposed at an angle with respect to the longitudinal axis; a milling arrangement comprising a milling head and a guidance surface, wherein the guidance surface is disposed at an angle with respect to the longitudinal axis of the tool and is in contact with the deflection surface; and a drive arrangement which is operable to effect relative longitudinal movement between the main body and the milling arrangement.

Advantageously, the tool further comprises a transmission arrangement operable to transmit rotational motion to the milling head.

Preferably, relative longitudinal motion of the main body and the milling arrangement causes lateral motion of the milling arrangement with respect to the main body, in a direction which is perpendicular to the longitudinal axis of the tool.

Conveniently, the transmission arrangement comprises a drive shaft which passes through at least part of the main body.

Advantageously, the drive shaft has a lower part, which is connected to the milling arrangement, and an upper part, wherein in at least one configuration of the tool the lower part and upper part are substantially parallel with one another, and offset with respect to one another.

Preferably, the tool further comprises an intermediate part extending between the lower part and the upper part.

Conveniently, an upper universal joint connects the upper part of the drive shaft to the intermediate part, and a lower universal joint connects the lower part to the intermediate part.

Advantageously, the intermediate part is of variable length.

Preferably, the tool further comprises a stabilising arrangement which is operable to prevent or hinder rotation of the tool within a borehole.

Conveniently, the stabilising arrangement may be selectively activated to grip against the internal surface of a casing of the borehole.

Advantageously, the tool is connected to the stabilising arrangement so that the tool may move longitudinally within the borehole with respect to the stabilising arrangement.

Preferably, the tool further comprises a rotational drive mechanism, operable to apply rotational motion to the transmission arrangement.

Conveniently, the rotational drive mechanism may be operated through the flow of fluid passing therethrough.

Advantageously, the drive arrangement comprises one or more actuating members extending between the main body and the milling arrangement.

Preferably, the or each actuating member is connected to the milling arrangement, or to the main body, in such a way that the actuating member may slide laterally with respect to the milling arrangement or main body.

Conveniently, the drive arrangement is operated to effect relative longitudinal movement between the main body and the milling arrangement, leading to lateral motion of the milling arrangement with respect to the main body, the rotational orientation of the guidance surface of the milling arrangement with respect to the main body remains substantially unaltered.

Advantageously, the milling head is attached to the guidance surface.

Preferably, a release arrangement is provided to allow the milling head to be detached from the main body of the tool.

Another aspect of the present invention provides a method of milling a window in the casing of a borehole, the method comprising the steps of: providing a tool according to any preceding claim; incorporating the tool into a drill string; lowering the drill string into a borehole having a casing; driving rotation of the milling head through the transmission arrangement; activating the drive arrangement to effect relative longitudinal movement between the main body and the milling arrangement, causing the milling arrangement to move laterally with respect to the main body, so that the milling head comes into contact with the casing; and raising and/or lowering the tool within the borehole to mill a window in the casing.

Conveniently, the method further comprises the step, when the window has been milled, of activating the drive arrangement to reverse the longitudinal motion of the main body with respect to the milling arrangement, so the milling head no longer contacts or overlaps with the casing.

Advantageously, the method further comprises the steps, when the window has been milled in the casing, of: fixing a whipstock in place in the borehole in the region of the window; and activating a drilling head and driving the drilling head downwardly along the whipstock so that the drilling head is deflected by the whipstock through the window to drill into the formation surrounding the casing.

Preferably, the method further comprises the step, before the window is milled in the casing, of activating the stabilising arrangement to grip against the internal surface of the casing of the bore hole.

Conveniently, the method further comprises the step of orienting the tool radially within the borehole before the step of activating the drive arrangement.

BRIEF DESCRIPTION OF THE DRAWINGS

In order that the invention may be more readily understood embodiments thereof will now be described, by way of example, with reference to the accompanying drawings, in which.

DETAILED DESCRIPTION

Figure 3:
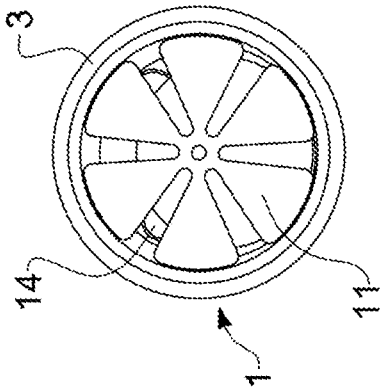
FIGS. 1 to 3 show a tool embodying the present invention in a first configuration.
Figure 1:
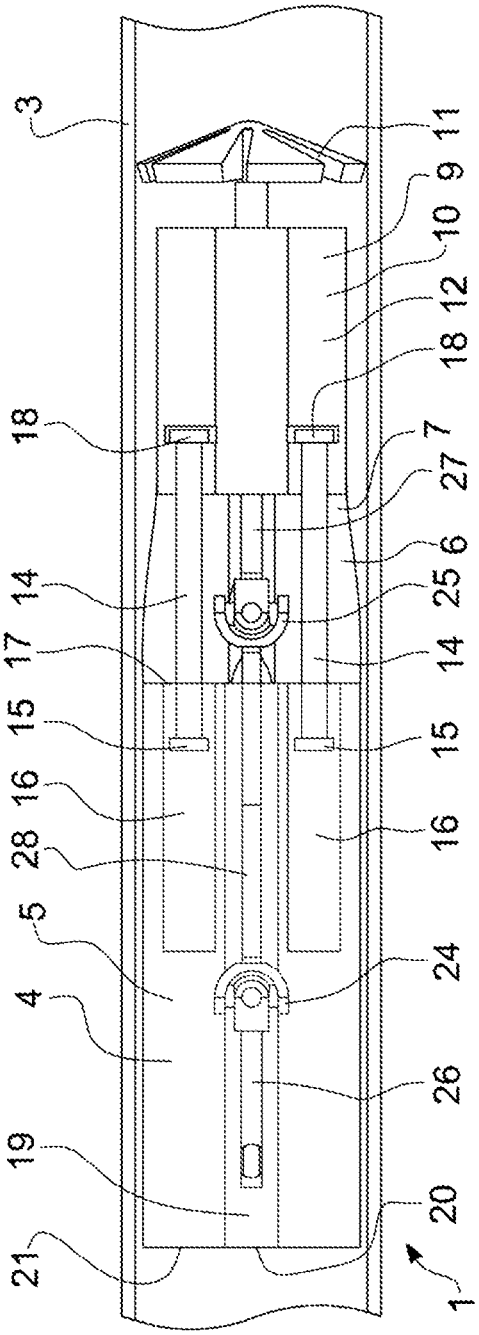
Figure 2:
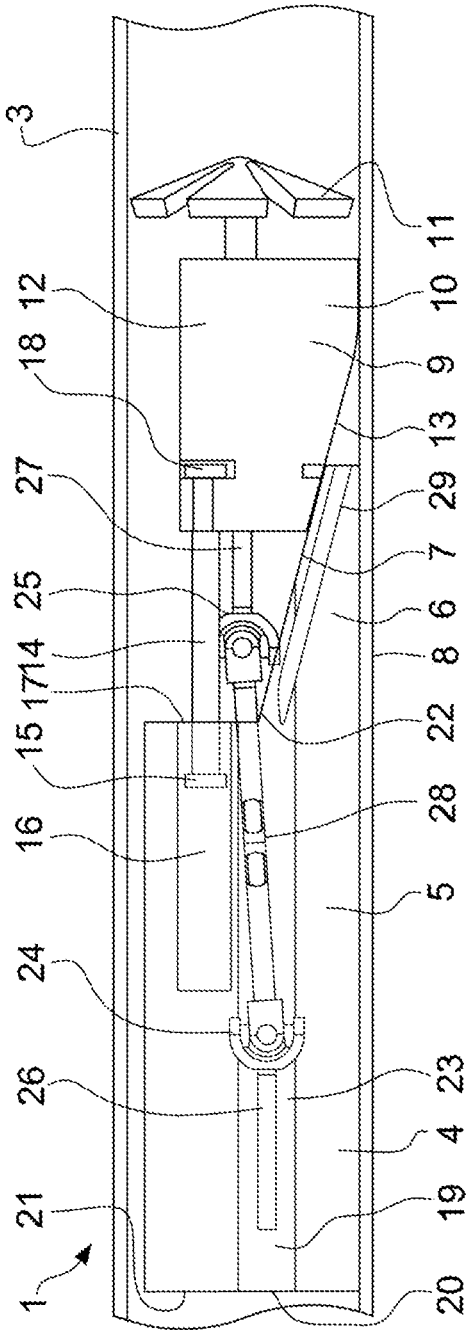

Turning firstly to FIGS. 1, 2 and 3, views are shown of a tool 1 embodying the present invention in an initial configuration. FIG. 1 shows a top-down view of the tool 1. FIG. 2 shows a side view of the tool 1.

The tool 1 is shown within a casing 3 which, in practice, will line a borehole (not shown).

The tool 1 comprises a main body 4. The main body 4 includes a main portion 5 and a deflection portion 6. In the depicted embodiment, the main portion 5 is generally cylindrical in shape, and fills or substantially fills the casing 3. This helps to maintain the tool 1 in the correct position laterally with respect to the casing 3.

The deflection portion 6 protrudes from the lower part of the main portion 5. In FIGS. 1 and 2, the direction left-to-right corresponds to the direction top-to-bottom in use of the tool 1.

In general, the tool 1 is expected to be oriented so that the main portion 5 of the main body 4 is nearer the top of the borehole, and the deflection portion 6 of the main body 4 is nearer the bottom of the borehole. In this specification, terms such as "top", "bottom", "lower" and "upper" are used in this context for convenience. However, it is envisaged that the tool 1 may be used in any orientation.

The deflection portion 6 includes a tapered driving face 7, which is set at an angle with respect to the longitudinal axis of the casing 3 or the borehole in which the casing 3 is positioned. In preferred embodiments, the angle may be around 10°-20°, and more preferably may be around 15°.

An outer surface 8 of the deflection portion 6 is preferably curved, to match or substantially match the internal curvature of the casing 3, and may preferably follow and be generally aligned with the curvature of the outer surface of the main portion 5 of the main body 4. In some embodiments, the cross-sectional shape of the outer surface 8 of the deflection portion 6 may include a flattened section, creating a chord with respect to the internal circumference of the casing 3. This will help to create point contacts at each end of the chord, and may also create space for cuttings and other debris generated in a milling operation (explained below) to be received.

The driving face 7 comprises an inner part of the deflection portion 6. The deflection portion 6 is, in the example shown, widest where it meets the main portion 5, and becomes progressively narrower further away from this point. The deflection portion 6 therefore occupies a smaller proportion of the overall cross-sectional area of the borehole the further it gets from the point where it meets the main portion 5 of the main body 4.

In embodiments shown, at its widest point the deflection portion 6 fills around half of the cross-sectional area of the casing 3.

In preferred embodiments, the driving face 7 is generally straight and flat, and tapers gradually along the length of the deflection portion 6. However, in other embodiments the driving face 7 may be curved, so that it is convex or concave over at least a part of its length.

The tool 1 further comprises a milling assembly 9. The milling assembly 9 includes a guidance portion 10 and a milling head 11.

The guidance portion 10 has a body 12 which includes, on one side thereof, a guidance face 13. The guidance face 13 is inclined with respect to the longitudinal axis of the casing 3 at the same, or substantially the same angle, as the driving face 7.

In the example shown, the body 12 of the guidance portion 10 is otherwise generally cylindrical, and has a diameter which is less than that of the main part 5 of the main body 4. The body 12 of the guidance portion 10 may take any other suitable shape, however.

The body 12 of the guidance portion 10 is arranged so that it contacts the driving face 7. In the initial configurations shown in FIGS. 1-3, an upper part of the guidance face 13 contacts and lies against a lower part of the driving face 7. Since the angles of these two surfaces 7, 13 with respect to the borehole are the same or substantially the same, where these surfaces 7, 13 meet they are parallel or substantially parallel with one another.

A pair of actuating members 14 extend between the main body 4 and the guidance portion 10. The actuating members 14 are operable to effect relative longitudinal movement (i.e. movement in a direction parallel or generally parallel with the longitudinal axis of the borehole) between the main body 4 and the milling assembly 9.

In the example shown in the figures, the actuating members 14 comprise hydraulic pistons. A first end 15 of each piston is received in a bore 16 formed in the main part 5 of the main body 4. In this example, each bore 16 is formed in the region of the main part 5 of the main body 4 that is not longitudinally in line with the deflection portion 6. Each bore 16 extends from a face 17 of the main part 5 which is level with the region where the deflection portion 6 meets the main part 5.

Contained within each bore 16 is a hydraulic mechanism (not shown) for withdrawing each actuating member 14 into the bore 16, or extending the actuating member 14 outwardly from the bore 16.

A fluid supply arrangement (not shown) is also provided to deliver hydraulic fluid to, and remove hydraulic fluid from, the bores 16 to actuate the actuating members 14.

At a second end 18, each actuating member 14 is connected to the body 12 of the guidance portion 10. In preferred embodiments, each actuating member 14 is connected to the body 12 of the guidance portion 10 in such a way that the body 12 may slide in a lateral direction, substantially away from the driving face 7, with respect to the actuating member 14. In the embodiment shown, each actuating member 14 terminates at its second end 18 in a generally T-shaped connector, and the body 12 has a pair of corresponding T-shaped grooves formed through all or part of its depth. The second end 18 of each actuating member 14 may slide within the corresponding T-shaped groove 29, thus allowing relative lateral motion between the actuating member 14 and the body 12. Any other convenient shape may also be used for the connectors and the grooves, rather than T-shapes.

While two actuating members 14 are shown in the figures, only one, or any other number, of actuating members may be utilised.

The main body 4 has a central drive passage 19 formed therethrough, passing between a first aperture 20 formed on a top face 21 of the main body 4, and a second aperture 22 formed on a lower part of the main body 4. In the example shown, the second aperture 22 is formed at the region where the deflection portion 6 meets the main portion 5.

A drive shaft 23 passes through the drive passage 19. In the example shown, the drive shaft 23 includes two universal joints 24, 25 (or other joints that allow rotation to be transmitted between two shafts which meet at a variable angle) at spaced-apart locations along its length. In this example a first universal joint 24 is positioned part way along the drive passage 19 and a second universal joint 25 is provided in the region between the main part 5 of the main body 4 and the body 12 of the guidance portion 10.

An upper part 26 of the drive shaft 23, above the first universal joint 24, is generally parallel with the longitudinal axis of the wellbore 2 and is aligned with the drive passage 19. A lower part 27 of the drive shaft 23, below the second universal joint, passes through the body 12 of the guidance portion 10. The universal joints 24, 25 and an intermediate portion 28 of the drive shaft 23 that extends between the universal joints 24, 25, are provided between the upper portion 26 and lower portion 27 of the drive shaft 23.

In this example the intermediate portion 28 of the drive shaft 23 has a variable length. For instance, the intermediate portion 28 may be formed in two or more telescoping sections, with appropriate interlocking teeth or a key and keyway (or any other suitable arrangement), as the skilled reader will understand, to ensure that rotational motion is transmitted between the parts of the intermediate portion 28.

The skilled reader will appreciate that this arrangement comprises a cardan shaft. The drive shaft 23 may be rotated, and the lower part 27 may be laterally deflected (i.e. deflected in a direction which is generally perpendicular to the longitudinal axis of the wellbore 2), while remaining generally parallel with the upper part 26 of the drive shaft 23, and while retaining the ability for the drive shaft 23 to be rotated and transmit rotational drive from the upper part 26 thereof to the lower part 27.

The lower part 27 of the drive shaft 23 passes all the way through the body 12 of the guiding portion 10, protruding from the bottom thereof, and is connected with a milling head 11 at its lower end. Rotation of the drive shaft 23 therefore leads to rotation of the milling head 11.

The drive shaft 23 can be connected to a gearbox (not shown) if there is a need to vary the rotational speed of the milling head 11 with respect to the rotational speed that is applied to or imparted to the drive shaft 23.

In the example shown in the figures, the milling head 11 is generally circular in cross-sectional shape. The milling head 11 is preferably of a diameter which fills, or substantially fills, the wellbore 2. The perimeter of the milling head 11 therefore lies close to the casing 3 in all directions. However, any other suitable shape of milling head 11 may be used.

In the example shown in the figures, the milling head 11 is positioned at the lowest point of the tool 1. In practical embodiments the upper end of the tool 1 will include a connection arrangement (not shown) to allow the tool 1 to be connected to another component of the drill string. This connection arrangement may take the form of a standard threaded connection.

Use of the tool 1 will now be described.

The tool 1 is incorporated into a drill string, and is preferably the lowest or final component of the drill string, provided at the distal end thereof. The drill string preferably also includes a drive arrangement which is operable to cause rotation of the drive shaft 23. The drive arrangement could be a down hole motor (pdm), a turbine, an electric motor, a hydraulic motor, or any other suitable means of providing rotation under load. The drive arrangement may be provided as part of the tool 1, or alternatively may be provided as, or as part of, a separate component in the drill string.

The drive arrangement must be operable from the surface, and a skilled reader will appreciate various ways in which this may be achieved. For instance, a flow of fluid through the drill string may be used to operate the drive arrangement, with the flow of fluid itself providing the power for rotation. The greater the rate of fluid flow through the drill string, the greater the power available to the drive arrangement.

In embodiments, an arrangement may be in place to allow fluid to flow and circulate through the drill string during a set up period, without operating the drive arrangement. For instance, the drive arrangement (and/or one or more surrounding components) may include a first fluid flow path, which does not lead to activation of the drive arrangement. When it is desired to activate the drive arrangement, fluid flow may be diverted along a second path, which does lead to activation of the drive arrangement. To achieve this, for example, a ball may be dropped along the drill string, to land in a seat, blocking the first fluid passage and diverting fluid along the second flow path. Alternatively, an indexing system may be used, in combination with a circulation valve, and operated in a suitable manner to divert fluid flow at the appropriate time.

The drill string is run into the borehole in a conventional fashion. When the tool 1 is at the depth at which a window is to be milled, the drive arrangement is activated, and rotation of the drive shaft 23 begins, leading to rotation of the milling head 11. In preferred embodiments the rate of rotation of the milling head 11 may be around 80-120 rpm, depending at least in part on the type and structure of the milling head 11.

The actuating members 14 are then operated to move the guidance portion 10 longitudinally towards the main portion 5 of the main body 4, while maintaining the depth or axial position of the drill string within the wellbore.

As this occurs, the guidance surface 13 of the guidance portion 10 will slide against the driving face 7 of the deflection portion 6 of the main body 4. Because these surfaces 7, 13 are inclined with respect to the longitudinal axis of the borehole, this will drive the guidance portion 10 laterally with respect to the longitudinal axis of the borehole, and into contact with the casing 3.

Rotation of the milling head 11 continues during this process. Because of the cardan shaft formed by the two universal joints 24, 25, the drive shaft 23 deflects to track the movement of the guidance portion 10, so rotational motion can still be transmitted through the drive shaft 23 to the milling head 11.

Figure 6:
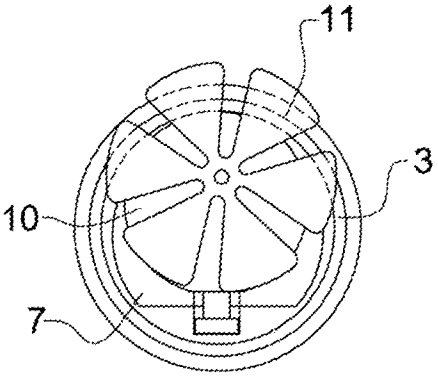
FIGS. 4, 5 and 6 show the tool of FIGS. 1 to 3 in a second configuration.
Figure 4:
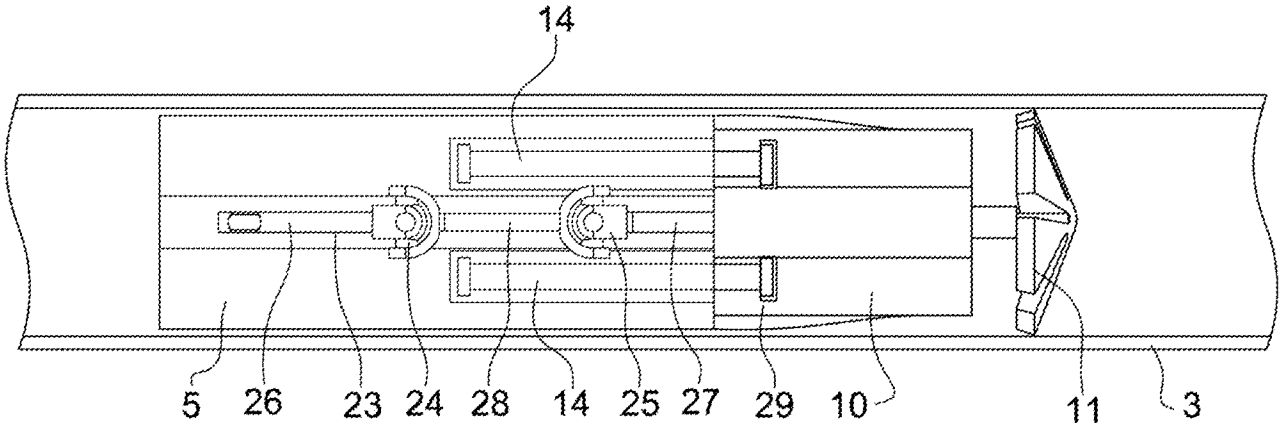
Figure 5:
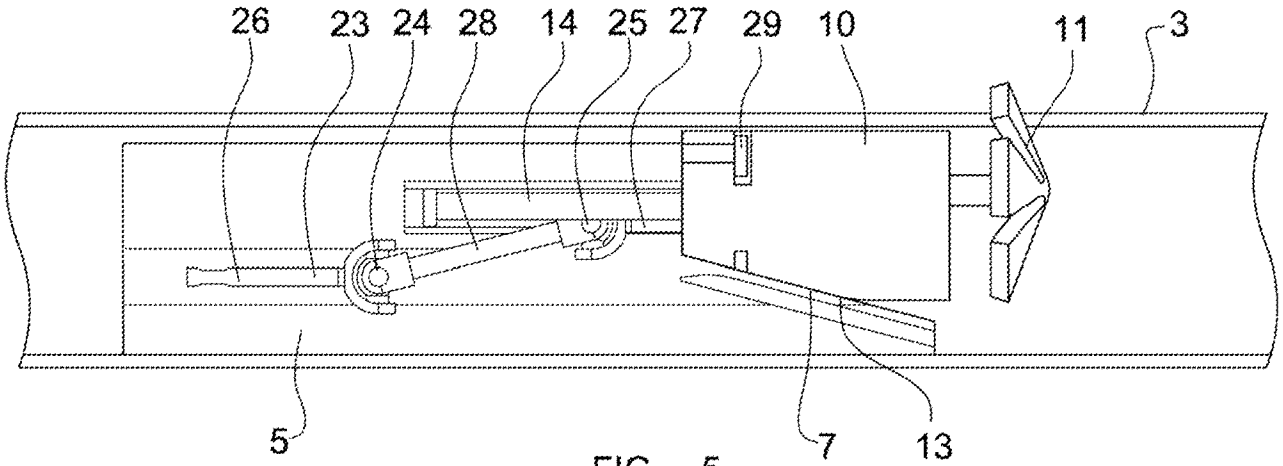

The actuating members 14 pull the guidance portion 10 towards the main portion 5 of the main body 4 until the milling head 11 is in a fully deployed position, which is shown in FIGS. 4, 5 and 6, which are views corresponding to those of FIGS. 1, 2 and 3, respectively. In preferred embodiments, in this fully deployed position preferably around half of the circumference of the milling head 11 intersects with the casing 3, or protrudes through the casing 3 to its exterior side.

Preferably, in the fully deployed position the milling head 11 intersects or passes through at least around one fifth of the circumference of the casing. More preferably, the milling head 11 passes through or intersects at least around one quarter of the circumference of the casing 3, and yet more preferably the milling head 11 passes through or intersects at least around one third of the circumference of the casing 3. As the body 12 of the guidance portion 10 moves laterally with respect to the main body 4, the body 12 will also move longitudinally upwardly with respect to the main body 4. Because the intermediate portion 28 of the drive shaft 23 has a variable length, the intermediate portion 28 can reduce in length to allow the upper universal joint 24 to remain fixed in place, while the lower universal joint 25 moves upwardly with respect to the borehole.

Once the milling head 11 has moved into its fully deployed position, the drill string may be raised or lowered so that the milling head 11 mills an elongate window in the casing 3. It will be understood that the drill string may be moved through any desired distance, to mill a window of any desired length. A window of a suitable length for use in the formation of a secondary bore may be, for example, around 6 m (18 ft), but a window of any other suitable length may be formed, depending on the particular application. In general, it will be preferable not to mill through the coupling between two sections of casing, and the length of each section of casing used in the region of the window being milled may set an upper limit on the total length of the window.

The window will be milled in a parallel fashion, i.e. using a milling head which, during the milling operation, is not moving with respect to the casing 3 at an angle which is offset from the longitudinal axis of the borehole. Rather, the milling head 11 will move in a manner which is parallel with the longitudinal axis of the borehole. This will lead to a window being milled which has a uniform or substantially uniform cross-sectional profile along its length.

Milling a window in the casing 3 may take from around 2-3 hours to around 8-9 hours, depending on factors including the length of the window, the type of milling head and the material from which the casing 3 is formed.

Once a window having the desired length has been milled, the milling head 11 can be returned to its initial configuration by using the actuating members 14 to drive the guidance portion 10 back to its initial position, i.e. that shown in FIGS. 1-3. This can be achieved by retracting the actuating members, thus pushing the guidance portion 10 down the driving face 7. The drill string may be raised within the borehole before or during this operation.

It is envisaged that, once this has been completed, the drill string may be lowered further into the borehole. The drill string may include, above the tool 1, a bridge plug, a whipstock and a drilling head. The bridge plug may be set in the wellbore 2 at a location below the window that has been milled in the casing 3. The whipstock may be fixed to, or fixed in position with respect to, the bridge plug so that the inclined face of the whipstock is substantially opposite the window that has been milled in the casing. Finally, the drilling head may be activated and pushed downwardly along the whipstock face, so that the drilling head passes through the window that has been milled in the casing, and can begin drilling a secondary bore in the formation surrounding the borehole.

In order to determine that the bridge plug and/or whipstock are set at the correct depth with respect to the window that has been milled in the casing, a locator arm or similar component may be used, to detect the depth and/or rotational position of the window that has been milled in the casing. Operators can use signals from this locator arm to ensure that the bridge plug and/or whipstock are set and oriented correctly before the drilling operation begins. A fixed location relative to the window, such as a latch coupling, may also be used for anchoring or as a reference point for depth and/or orientation purposes.

When milling a window in the casing of a borehole for this purpose, it is important that the alignment of the window with respect to the casing 3 (i.e. the radial angle at which the window is formed) remains constant along the length of the window. Since the milling head 11 will be rotating at a high speed during the milling operation, relative rotational forces (e.g. torque reaction) will occur between the casing 3 and the milling head 11. There is therefore a risk that these forces may cause the milling head 11 to move radially around the casing 3, thus milling a window which is not correctly aligned on the casing 3 or having an alignment which is not constant along the length of the window.

In embodiments, a stabilising component may be included as part of the tool 1, or provided as a separate component in the drill string, to maintain the rotational alignment of the tool 1 as the milling operation is carried out.

In one example, a stabilisation arrangement is provided (preferably located immediately above the tool 1, or as close as possible to the tool 1 within the drill string), and comprises a packer or similar grip arrangement which is able to grip against the internal surface of the casing 3, thus fixing the packer or other grip arrangement in place both longitudinally and rotationally with respect to the casing 3. As the skilled reader will understand, a reversible packer or other grip arrangement of this kind may be activated and subsequently de-activated from the surface, for instance using fluid flow/pressure, or by moving the drill string upwardly or downwardly with respect to the borehole.

The stabilisation arrangement has an aperture formed therethrough, and an elongate orienting member passes through the aperture and is connected to the tool. The orienting member may slide longitudinally with respect to the grip arrangement, and the aperture and the orienting member preferably have cooperating cross-sectional shapes that prevent relative rotation of these two components, for instance a splined, cross-, star-, gear-, square- or hexagonal-shaped cross-sectional shape.

Once the grip arrangement is fixed in place with respect to the casing, the remainder of the drill string, including the tool, may be moved upwardly or downwardly with respect to the borehole, to mill a window in the casing of the borehole. As this occurs, the orienting member will prevent rotational motion of the tool with respect to the borehole, but the fact that the orienting member may slide longitudinally with respect to the grip arrangement means that upward and downward motion of the tool will not be inhibited.

In use, the stabilisation arrangement will preferably be activated before any rotational motion of the milling head 11 takes place, so that the tool 1 is held in place rotationally with respect to the casing 3 before any relative forces act between the milling head 11 and the casing 3 as a result of the rotation of the milling head 11.

Once the window has been milled, the packer or other grip arrangement may be deactivated, so that the stabilisation arrangement no longer grips the internal surface of the casing 3 and the drill string as a whole may be moved upwardly and downwardly within the borehole.

As the milling operation proceeds, cuttings will be generated, comprising pieces of the casing 3 which have been cut and broken away. If these cuttings are allowed to accumulate, they may interfere with or even stop the milling operation. The main options for preventing the build-up of cutting are simply to allow the cuttings to fall down the borehole, or to arrange for the cuttings to be carried away by drilling fluid which is circulated as the milling operation is in progress. The cuttings may be carried downwardly into the borehole by the drilling fluid, or alternatively may be carried upwardly to the surface. Additionally, or as an alternative, one or more magnets may be mounted on or near the tool 1, near the location where the cuttings will be generated, to trap some or all of the cuttings.

While the milling assembly 9 is in the deployed position, it may be necessary to remove the drill string from the wellbore. In these circumstances it may not be possible to disengage the milling head from the casing easily, or without causing undesirable damage to the casing. For this reason, in embodiments of the invention a release arrangement (for instance, taking the form of a frangible connection) may be provided to allow the milling assembly, or a part thereof including the milling head, to be released from the main body of the tool. This will allow as many possible components as possible to be recovered from the wellbore. One or more subsequent runs into the wellbore may be made, with specialised tools, to recover the equipment that has been left in the wellbore. Alternatively, the equipment that remains in the wellbore may be left in the wellbore permanently.

It will be understood that embodiments of the invention provide a robust and reliable mechanism for milling a full-gauge and parallel window in a casing, to allow a sidetrack bore to be drilled effectively. Tools embodying the invention may be included in the same drill string as a whipstock and drilling head, thus allowing the window to be milled in the casing and the drilling of the sidetrack bore begun in a single trip.

When used in this specification and the claims, the term "comprises" and "comprising" and variations thereof mean that specified features, steps or integers and included. The terms are not to be interpreted to exclude the presence of other features, steps or compounds.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realising the invention in diverse forms thereof.

The invention claimed is:

1. A tool for milling a window in the casing of a borehole, the tool comprising:

a main body having a longitudinal axis wherein, when the tool is run into a borehole, the longitudinal axis is substantially parallel with the longitudinal axis of the borehole, the main body comprising a deflection surface which is disposed at an angle with respect to the longitudinal axis;

a milling arrangement comprising a milling head and a guidance surface, wherein the guidance surface is disposed at an angle with respect to the longitudinal axis of the tool such that the guidance surface is substantially parallel to the deflection surface and is in contact with the deflection surface for movement along a straight path following the deflection surface while the angles of the deflection and guidance surfaces remain fixed; and a drive arrangement which is operable to effect relative longitudinal movement between the main body and the milling arrangement, wherein the drive arrangement comprises one or more actuating members extending between the main body and the milling arrangement, wherein the one or more actuating members are connected to the milling arrangement, or to the main body, in such a way that the one or more actuating members may slide laterally with respect to the milling arrangement or the main body, and wherein, when the drive arrangement is operated to effect relative longitudinal movement between the main body and the milling arrangement, leading to lateral motion of the milling arrangement with respect to the main body, the rotational orientation of the guidance surface of the milling arrangement with respect to the main body remains substantially unaltered.

2. A tool according to claim 1, further comprising a transmission arrangement operable to transmit rotational motion to the milling head.

3. A tool according to claim 2, wherein the transmission arrangement comprises a drive shaft which passes through at least part of the main body.

4. A tool according to claim 3, wherein the drive shaft has a lower part, which is connected to the milling arrangement, and an upper part, wherein in at least one configuration of the tool the lower part and upper part are substantially parallel with one another, and offset with respect to one another.

5. A tool according to claim 4, further comprising an intermediate part extending between the lower part and the upper part.

6. A tool according to claim 5, wherein an upper universal joint connects the upper part of the drive shaft to the intermediate part, and a lower universal joint connects the lower part to the intermediate part.

7. A tool according to claim 5, wherein the intermediate part is of variable length.

8. A tool according to claim 2, further comprising a rotational drive mechanism, operable to apply rotational motion to the transmission arrangement.

9. A tool according to claim 8, wherein the rotational drive mechanism may be operated through the flow of fluid passing therethrough.

10. A tool according to claim 1, wherein relative longitudinal motion of the main body and the milling arrangement causes lateral motion of the milling arrangement with respect to the main body, in a direction which is perpendicular to the longitudinal axis of the tool.

11. A tool according to claim 1, further comprising a stabilising arrangement which is operable to prevent or hinder rotation of the tool within a borehole.

12. A tool according to claim 11, wherein the stabilising arrangement may be selectively activated to grip against the internal surface of a casing of the borehole.

13. A tool according to claim 1, wherein the milling head is attached to the guidance surface.

14. A method of milling a window in the casing of a borehole, the method comprising the steps of:

providing the tool according to claim 1;

incorporating the tool into a drill string;

lowering the drill string into a borehole having a casing;

driving rotation of the milling head;

activating the one or more actuating members of the drive arrangement to effect relative longitudinal movement between the main body and the milling arrangement, causing the milling arrangement to move laterally with respect to the main body by the contact between the guidance surface and the deflection surface, so that the milling head comes into contact with the casing; and raising and/or lowering the tool within the borehole to mill a window in the casing.

15. A method according to claim 14, further comprising the steps, when the window has been milled in the casing, of:

fixing a whipstock in place in the borehole in the region of the window; and activating a drilling head and driving the drilling head downwardly along the whipstock so that the drilling head is deflected by the whipstock through the window to drill into the formation surrounding the casing.

16. A method according to claim 14, further comprising the step, before the window is milled in the casing, of activating a stabilising arrangement to grip against the internal surface of the casing of the bore hole.

17. A method according to claim 14, further comprising the step of orienting the tool radially within the borehole before the step of activating the drive arrangement.

* * * * *